US006101750A

United States Patent [19]

Blesener et al.

[11] Patent Number: 6,101,750

[45] Date of Patent: Aug. 15, 2000

[54] PORTABLE MESSAGE SIGN

[75] Inventors: James L. Blesener, White Bear Lake; Amir Amighi, St. Louis Park, both of Minn.

[73] Assignee: Power Engineering & Mfg., Inc.

[21] Appl. No.: 09/058,705

[22] Filed: Apr. 10, 1998

[51] Int. Cl.[7] ..... G09F 9/00

[52] U.S. Cl. ..... 40/448; 40/452; 340/815.53; 345/59

[58] Field of Search ..... 40/448, 452, 612; 340/815.53, 815.54; 345/55, 59, 87; 362/183

[56] References Cited

U.S. PATENT DOCUMENTS

| | | | |
|---|---|---|---|
| D. 298,146 | 10/1988 | Glover . | |
| 3,291,975 | 12/1966 | McCullough et al. | 40/573 |
| 3,975,728 | 8/1976 | Winrow . | |
| 4,006,476 | 2/1977 | Romney | 40/449 X |
| 4,389,804 | 6/1983 | Seibert et al. . | |
| 4,893,903 | 1/1990 | Thakar et al. | 40/448 X |
| 5,073,943 | 12/1991 | Weinreich | 40/448 X |
| 5,115,228 | 5/1992 | Harris et al. . | |
| 5,153,760 | 10/1992 | Ahmed . | |
| 5,174,649 | 12/1992 | Alston . | |
| 5,251,393 | 10/1993 | Gallone | 40/448 |
| 5,307,057 | 4/1994 | Cook et al. . | |
| 5,542,203 | 8/1996 | Luoma et al. . | |
| 5,563,621 | 10/1996 | Silsby | 345/43 |
| 5,819,455 | 10/1998 | Tsuda | 40/612 X |

FOREIGN PATENT DOCUMENTS

| | | | |
|---|---|---|---|
| 237707 | 9/1987 | European Pat. Off. | 40/448 |

*Primary Examiner*—Brian K. Green
*Attorney, Agent, or Firm*—Nikolai, Mersereau & Dietz, P.A.

[57] ABSTRACT

A changeable portable, solar powered message sign is disclosed which offers reduced power consumption and enhanced visibility to intended observers especially during the difficult hours about dawn and dusk. The system features character matrices and two independent types of pixel defining systems. The system also includes an automatic solar tracking and control system.

19 Claims, 7 Drawing Sheets

PORTABLE MESSAGE SIGN

BACKGROUND OF THE INVENTION

I. Field of the Invention

The present invention deals generally with changeable message signs and particularly with self-powered, usually solar powered, portable signs of the class which are typically deployed as temporary road signs. The present invention offers reduced power consumption, enhanced visibility to intended observers, especially during the difficult hours about dawn and dusk, and improved automatic solar tracking and control in changeable message signs.

II. Related Art

Changeable displays or changeable message signs used for exhibiting visual or written information which are capable of portraying several sequential segments of information in a complete message and being further selectively programmable to display other messages have long been used to display real time information to motorists and assist in efforts to improve roadway operations and safety. These changeable message signs (CMS) have been used to inform and advise those using the highway of construction and maintenance circumstances together with even weather traffic or other highway conditions. Such displays generally have two distinct applications. The first relates to stationary changeable message signs which can be hard wired as permanent installations. The second covers portable signs or mobile units which are designed to be transported for use in remote locations, but which usually require some sort of power supply that is part of or travels with the unit.

In recent years, three main types of illumination for CMS displays have emerged as common and accepted modes. The first type is a light-reflecting type which uses light received from external sources such as the sun, automobile headlights or other illuminators exclusively to operate the message sign. While somewhat successful, these devices are quite limited in terms of visibility and usefulness and are the least adaptable to changing conditions.

A second type is exclusively light emitting in which light is provided on or behind the viewing surface within the sign housing. Selectively exposed areas define the desired messages. A third type employs a hybrid technique which combines aspects of both reflective and light emitting technologies in combination. The second and third type produce superior results when it comes to presenting a display which is highly visible under a variety of lighting conditions.

Portable changeable highway display signs typically form a display from an arrangement that consists of 24 available characters arranged in a configuration including 3 rows of 8 characters each. Each individual character is typically formed from a configuration of 35 pixels arranged in a 5×7 matrix. The entire arrangement, then, requires 840 operable pixels. By arranging a pattern in the pixels of each character across each row, a sign can be produced which easily displays a simple message. Each 5×7 pixel matrix, of course, can be patterned into any desired letter or number or operated to image part of a larger scene, such as a large arrow. Thus, the pixels of each character matrix can be changed so that any desired message or sequence of messages can be displayed.

Generally, for highway use, the message must be plainly visible from a minimum distance of 900 feet. This allows the typical motorist to have the sign in sight for just over 10 seconds while traveling 60 miles per hour (88 ft/sec). This 10-second time frame also permits the sign to change and display two to three sequences of simple messages or parts of a larger message with sufficient time to allow the additional information to be appreciated by the motorist.

With respect to portable systems, improvements that reduce power consumption are of great importance inasmuch as these systems cannot be hard wired to permanent electrical sources and must depend entirely on auxiliary or portable power generating sources for operation. Early portable display devices of the class were generally rather crude systems. They were large energy consumers that required rather large diesel or gasoline powered motor/generator (MG) sets to supply electricity. These units had to be transported with the signs and which required a great deal of supervision including periodic refueling. In addition to high electrical usage for illumination as by incandescent or fluorescent lighting, the early signs generally employed a large number of electro-magnetically operated mechanical shutters (one per pixel) which were pivotally operated between two stable positions, each exposing a side of the shutter.

Exemplary devices using mechanical shutters are shown and described in U.S. Pat. No. 3,975,728 to Winrow which discloses arrays of electro-magnetically operated pivotally mounted pixel elements each having a lighter and a darker side. Siebert et al (U.S. Pat. No. 4,389,804) also disclose the use of multi-position magnetically operable pivoting disks for each array. Cook et al (U.S. Pat. No. 3,507,057) disclose a device that includes a fibre optic illumination source in conjunction with magnetically operated indicator elements.

Because of the high cost of MG set generated power and because of advancements in energy conversion systems, solar power has become an important source of power generation for these portable signs in recent years. One such system is disclosed by Luoma et al (U.S. Pat. No. 5,542,203) which utilizes solar power generation in conjunction with illumination by light emitting diodes (LEDs) operated in conjunction with mechanical pixels. A photovoltaic powered optical shutter system for a reflective display is shown in U.S. Pat. No. 5,153,760 to Ahmad. Harris et al (U.S. Pat. No. 5,115,228) discloses a double-sided electro optic display in which shutters on either side of a central display allow different messages to be transmitted from opposed sides.

In addition, although solar power has been introduced with respect to the operation of mobile, changeable sign displays, the efficiency of the production and use of the solar energy has been quite limited. For example, crude mechanical or hand-operated adjustment techniques have been utilized to approximately position the solar panels with respect to the incident sunlight or, heat seeking devices have been utilized in an attempt to adjust the relative angle of the solar panels. Thus, there remains a need for an inexpensive but more effective method of positioning the solar panel to maximize energy output.

It would be a desirable and recognized step forward in the art if there were presented a changeable message display which is capable of 24 hour self-sufficient operation utilizing solar energy as the sole source of power and which, at the same time, provides the high visibility under all types of conditions normally associated only with high energy consuming systems.

Accordingly, it is a primary object of the present invention to provide an improved self-sufficient electrically powered sign panel having a changeable display of reduced power consumption that requires no moving parts.

A further object of the invention is to provide an improved electrically powered sign panel that utilizes low energy consuming electro-optic (E-O) shutter technology in the display pixels.

A still further object of the invention is to provide an improved electrical sign panel that provides low glare, high contrast reflecting/emitting pixels to provide a time variable character matrix of optimal visibility at all ambient light levels.

A yet still further object of the invention is to provide an improved electrical sign panel that uses ambient sensed light controlled LED emitters to optimize visibility.

Another object of the invention is to provide an improved mobile electrical sign panel that uses ambient light sensed control for solar panel disposition.

Other objects and advantages will become apparent to those skilled in the art upon familiarization with the specification, drawings and claims contained herein.

SUMMARY OF THE INVENTION

In accordance with the present invention, many problems associated with prior art electrically powered sign panels of the class in which both visibility and power consumption are of concern have been solved by the provision of a system that combines reduced power consumption with aspects related to improved visibility. The display features unique character matrix pixels. The pixels use electro optic (E-O) shutter technology in combination with highly reflective background material (reflector) and output variable light emitters or light sources of relatively low power consumption located next to each shutter/reflector combination for supplementary LED illumination. This combination yields an advanced electro-optical pixel design that requires no moving parts yet offers high performance. The system conserves power during daylight by operating with reflected sunlight in high ambient light conditions and operates with emitted light in low ambient conditions.

A light sensitive photo detector, photo cell, or the like, is utilized to monitor the ambient light level. It will be appreciated with regard to this application that a variety of such devices capable of discriminating light levels in rather minute increments and transmitting digital or analog signals accordingly are available and any suitable such device can be used. Also, for the purposes of this application, the term electro-optic shutter refers to any suitable low power, non-mechanical light transmission-varying shutter device which can be employed to conveniently expose and conceal or obscure a reflector. The output-variable, low power light emitters may be light emitting diode (LED) devices, as described in the detailed description, but it is intended that any other suitable device of the class may also be used.

The embodiment of the electrically powered sign panel of the detailed description of the invention illustrates the invention with regard to a mobile solar powered changeable message sign of a type commonly associated with expediting travel through and around highway work zones safely. The sign panel is powered by a battery charged by a solar panel which can be automatically positionally controlled with respect to the sun utilizing the same photo cell that controls the operation of the sign panel. This may be accomplished utilizing an electro-mechanical servo system to adjust the positional direction of the solar panel in two dimensions (vertical tilt or elevation and rotational or directional position) in accordance with the light observed by the photo detector.

Each pixel includes an electro-optic shutter which includes, for example, a crystalline dichroic liquid crystal shutter medium sandwiched between a pair of glass plates. The shutter normally exhibits low transmission and low reflectance when no electrical energy is applied to the system. Application of electrical energy across the dichroic liquid aligns the randomly oriented liquid crystals and allows high transmittance of incident light energy. Behind the electro-optic shutter, each pixel includes a layer of highly reflective material such as diamond grade reflective sheeting. One such material is Scoehlite® available in a variety of colors from 3M Company, St. Paul, Minn., which provides a reflective surface behind the shutter and which reflects incident light in accordance with the operation of the electro-optic shutter. Operation of each E-O shutter requires only about 10 $\mu$a or less of current vs. about 100 ma overage for a mechanical shutter. Each pixel also requires only a single pair of light emitting diodes (LEDs) to provide full illumination in the emission mode in cooperation with the electro-optic shutter.

As indicated, the electro-optic shutters are preferably low power, normally closed devices such that, in operation, when energized or opened, each electro-optic shutter requires a very low current (approximately 10 micro amperes or less), while closed shutters use none. It should also be noted that the energy required to switch messages in accordance with the utilization of these electro-optic shutters is usually no more than for operating the then current message, other than any consumption increase caused by an increase in the total number of energized pixels required to produce the new message. This is far less energy than that required to energize current electro-magnetically operated shutter devices, for example. In fact, the improvement typically represents a very significant power reduction in consumption which may be greater than two orders of magnitude during daylight operation when contrasting with a system utilizing mechanical shutters and operating LEDs during the daylight hours.

In other than broad daylight, the display panel of the invention utilizes LEDs in conjunction with a photo sensing device to modulate the amount of light given off by the LEDs depending on ambient conditions. Thus, at dawn and at dusk, where the conditions of contrast recognition are the lowest and the rate of change of ambient light is the greatest, the LEDs of the pixels utilized are operated in a full ON condition and thereafter generally reduced in increments or stepwise fashion as the ambient light level increases or decreases such that by the time full daylight is reached, the LEDs have been switched off and when full darkness occurs, the diode arrays have been reduced to a nighttime setting which is well below the maximum output. This ability to control the output level of the LEDs in this fashion, not only reduces power consumption, but also optimizes visibility to the passing motorist.

A further advantage of the combination of the electro-optic shutter and highly reflective inner material layer of the sign panel of the invention is in the power saved because it enables a reduction in the number of LEDs used. A typical present day CMS using LED emitter technologies for day operation requires 4 or 5 LEDs per pixel. It has been found that with the system of the present invention, only 2 LEDs per pixel are required to provide excellent visibility and contrast inasmuch as the system of the invention requires LED emitter operation only during low ambient lighting conditions and not to overcome the high ambient conditions of day operation.

BRIEF DESCRIPTION OF THE DRAWINGS

In the drawings wherein like numerals are utilized to designate like parts throughout the same.

DETAILED DESCRIPTION

The improvements of the present invention will be described in relation to a battery-operated mobile sign with a solar panel charging system for providing information to motorists anywhere along a highway of interest. It will be appreciated that this is meant to be exemplary of an application of the improvements associated with the invention, but by no means limiting with respect to the scope of their applicability. The improvements are believed useful in a variety of display applications.

Figure 1:
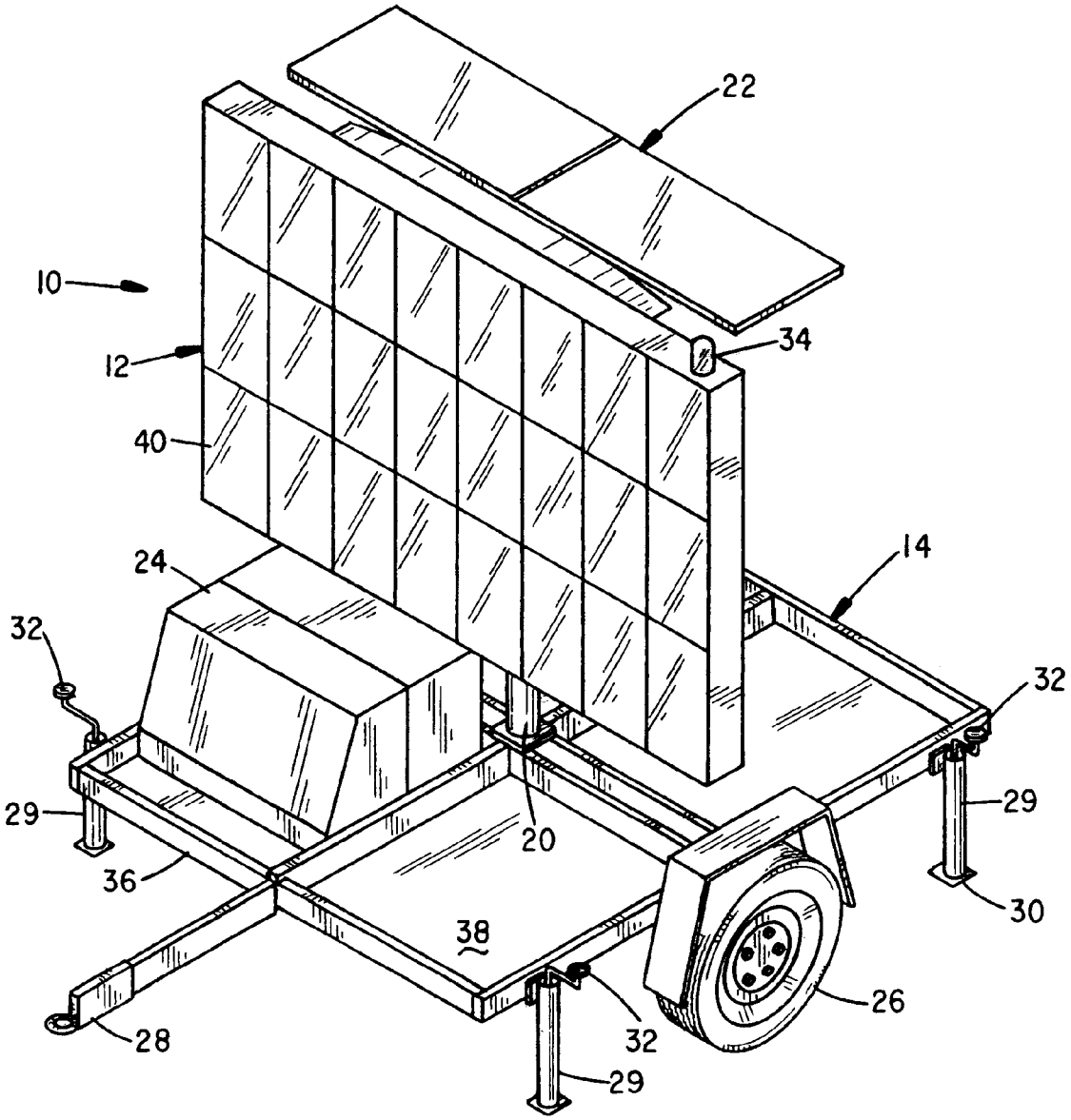
FIG. 1 is a perspective view of a solar-powered mobile sign constructed in accordance with the invention.
Figure 2:
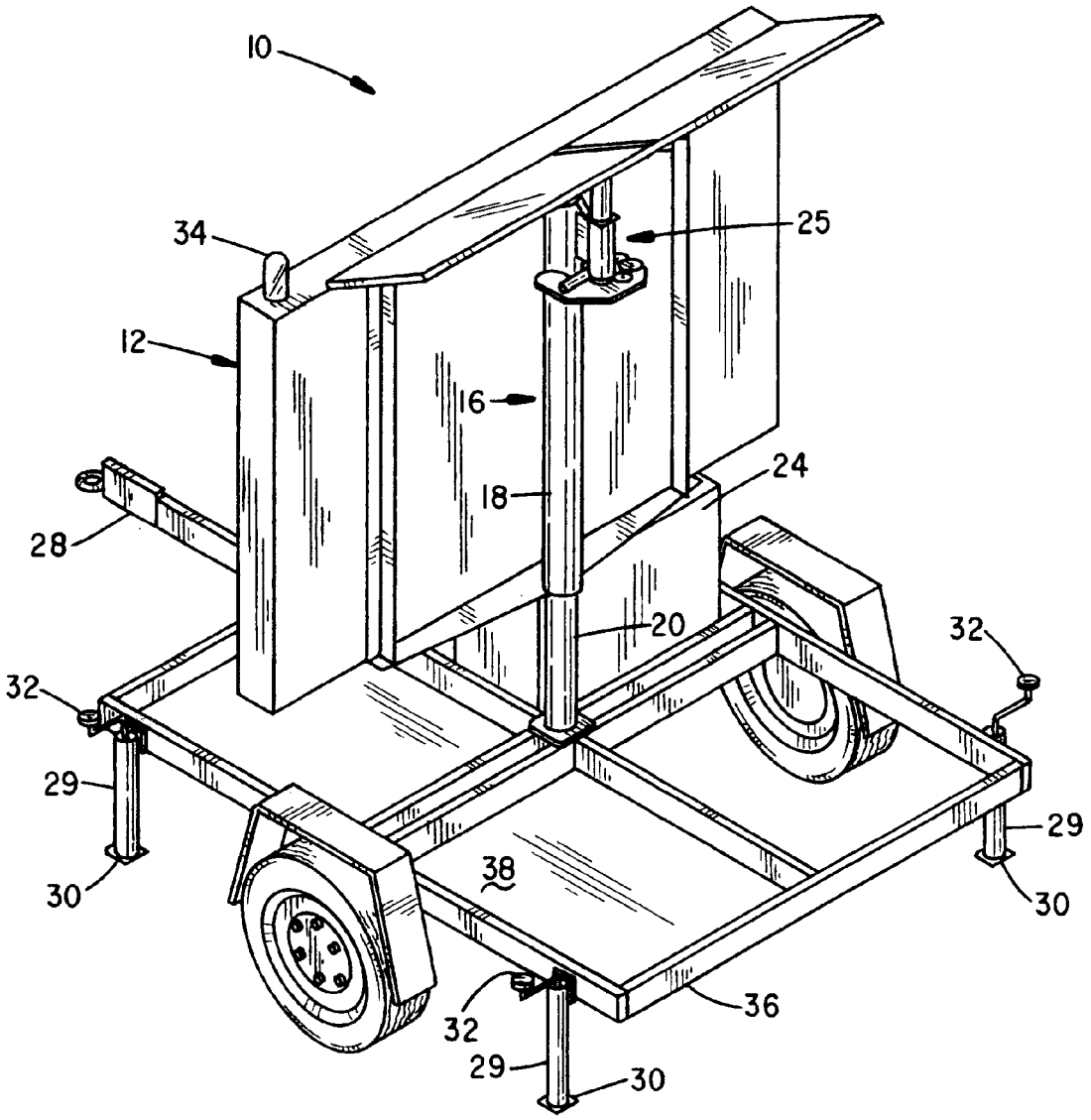
FIG. 2 is a perspective view of the rear portion of the mobile sign of FIG. 1.
Figure 3:
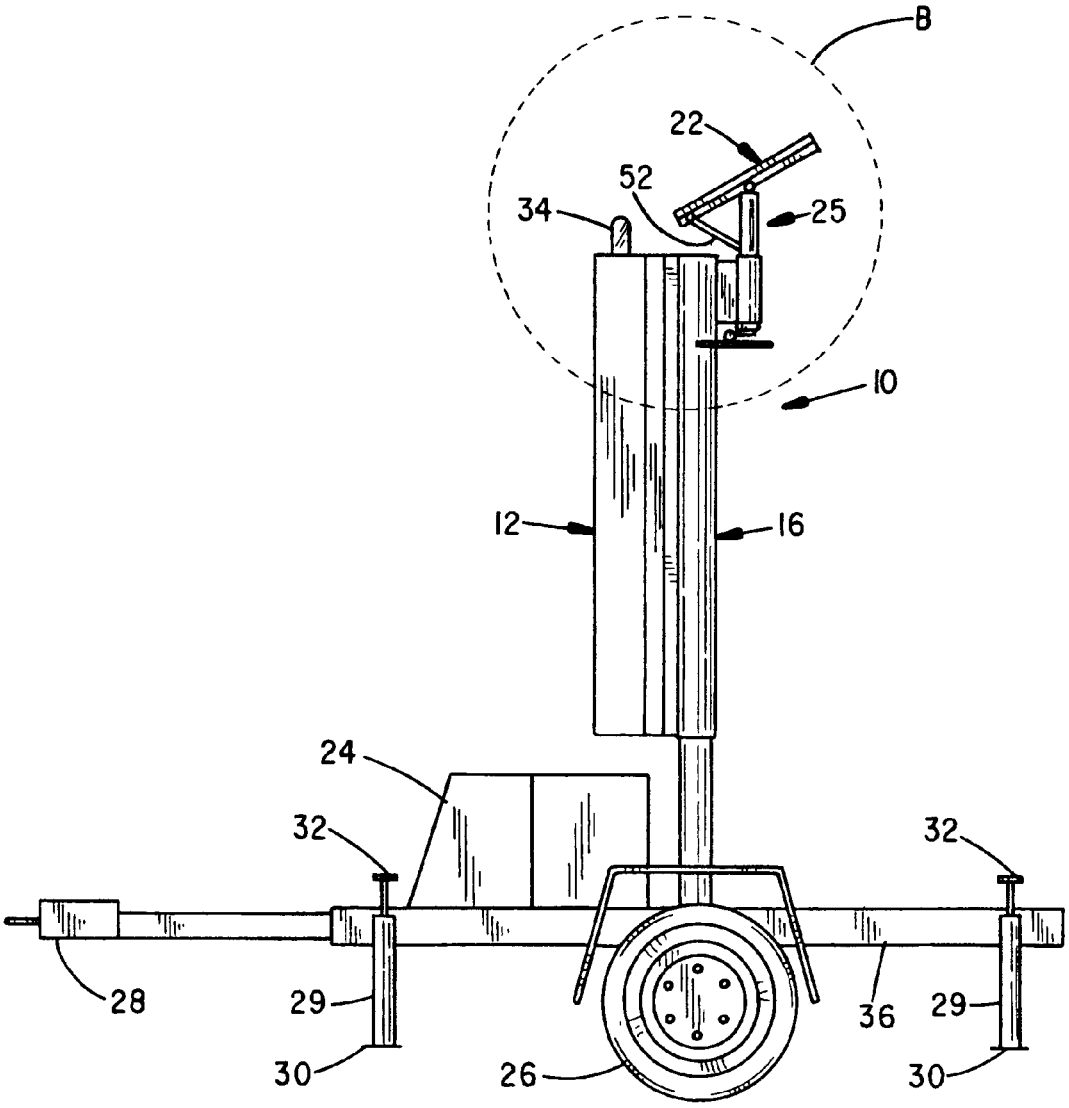
FIG. 3 is a side elevational view of the mobile sign of FIG. 1.

With this in mind, FIGS. 1–3 depict a mobile sign generally at 10 which includes a display panel 12 mounted on a wheeled vehicle chassis 14 as by a telescoping mast 16 having an upper tubular portion 18 (FIG. 2) telescoped over a lower portion 20. A conventional solar panel, generally at 22, contains a plurality of solar cells (not shown) which are conventionally connected by insulated conductors (not shown) to a rechargeable battery contained in a housing at 24. The solar panel 22 is mounted on a mast 25 (FIGS. 2 and 3) which itself telescopes and is also connected to the upper portion 18 of the telescoping mast 16 which carries the main powered sign panel 12. A photo detector 34 is shown mounted to the top of the electrically powered sign panel 12. The vehicle carrying the sign and solar panel is generally in the configuration of a 2-wheeled trailer vehicle having wheels as at 26 and a hitching tongue as at 28. The vehicle also includes vertically adjustable legs 29 to support the vehicle when in use as a sign and further including height adjustable feet members 30 with cranks 32 to stabilize and level the vehicle. The trailer is constructed of conventional metal shapes 36 and plates 38. Both the solar panel 22 and the sign panel 12 can be adjusted independent of the trailer chassis 14 so that the sign is independently height and direction adjustable relative to the chassis limited only by the extendability of the mast 16. The rechargeable battery is connected to the appropriate control circuitry and including the photo detector or cell 34 in a well known manner.

Figure 4:
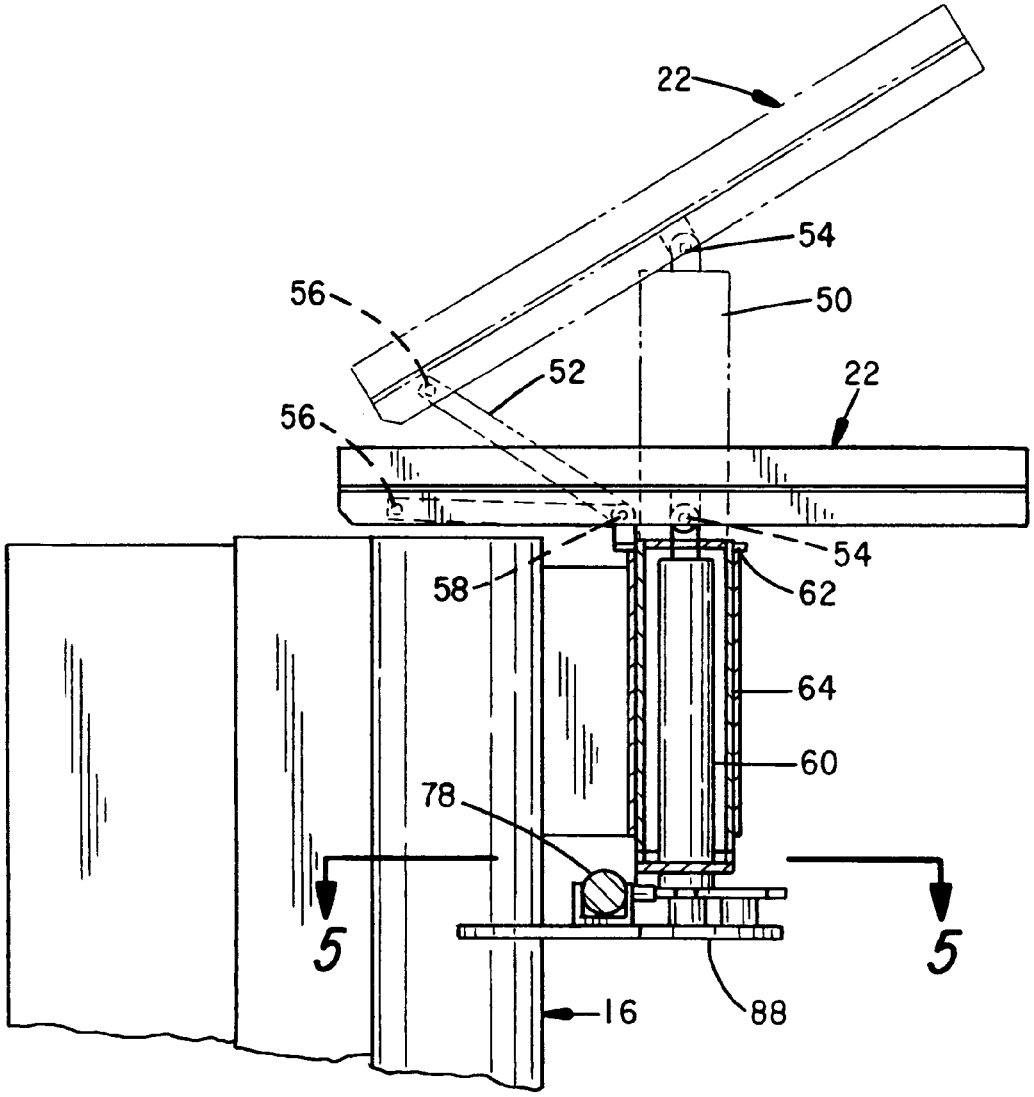
FIG. 4 is a greatly enlarged view partially in section of detail B of FIG. 3 depicting the solar panel positioning mechanism.
Figure 5:
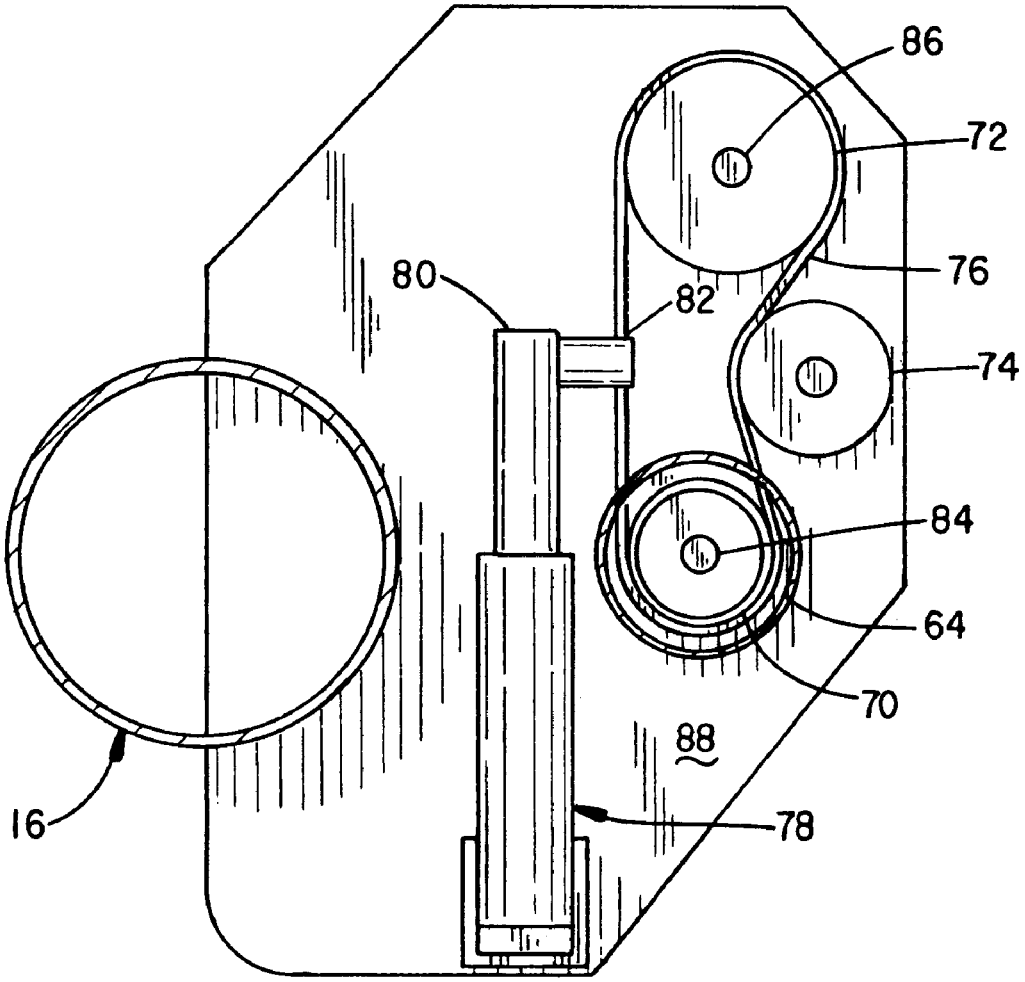
FIG. 5 is a further enlarged fragmentary sectional view taken along line 5—5 of FIG. 4 showing details of the rotating mechanism.

A mechanism associated with positioning (controlling the elevation and directional) disposition of the solar panel is best depicted in FIGS. 4 and 5. FIG. 4 represents a greatly enlarged fragmentary view of the detail B pictured in FIG. 3 in which the solar panel 22, telescoping section 50 of mast 25 and one or more elevation stabilizing struts as at 52 are shown raised in phantom and collapsed for highway travel in solid lines. The panel 22 is mounted to pivot vertically with respect to the mast 25 at 54 and struts 52 are mounted to freely pivot at 56 and 58. In this manner, increments telescoping of the section raises or lowers the angular elevation of the solar panel 22.

The mechanism further includes a linear actuator 60 for raising and lowering the telescoping or extending tube 50 and a stationary thrust bearing 62. An inner tube 64 over which the telescoping section 50 is slidably mounted is further designed to rotate and to thereby rotate the entire solar panel assembly. A mechanism to accomplish controlled rotation of the mast 25 is best shown in detail in the further enlarged sectional plan view of FIG. 5 and includes a pair of spaced drive sprockets 70 and 72, an idler sprocket 74 and drive chain or belt 76. The drive chain or belt 76 is advanced in either direction as by a linear actuator 78 with rod 80 and connecting member 82. The sprockets 70, 72 are mounted on spindles or axles 84 and 86, respectively, and the entire mechanism is mounted on a base plate 88.

Operation of the linear actuator in a reciprocal manner controls the directional or rotational aim of the solar panel. Likewise, the telescoping action of the mast controls the height of the panel. It will be recognized that electrical connection between said solar panel 22 and the storage battery can be made by threading insulated conductors through the masts 25 and 16, for example.

Figure 6:
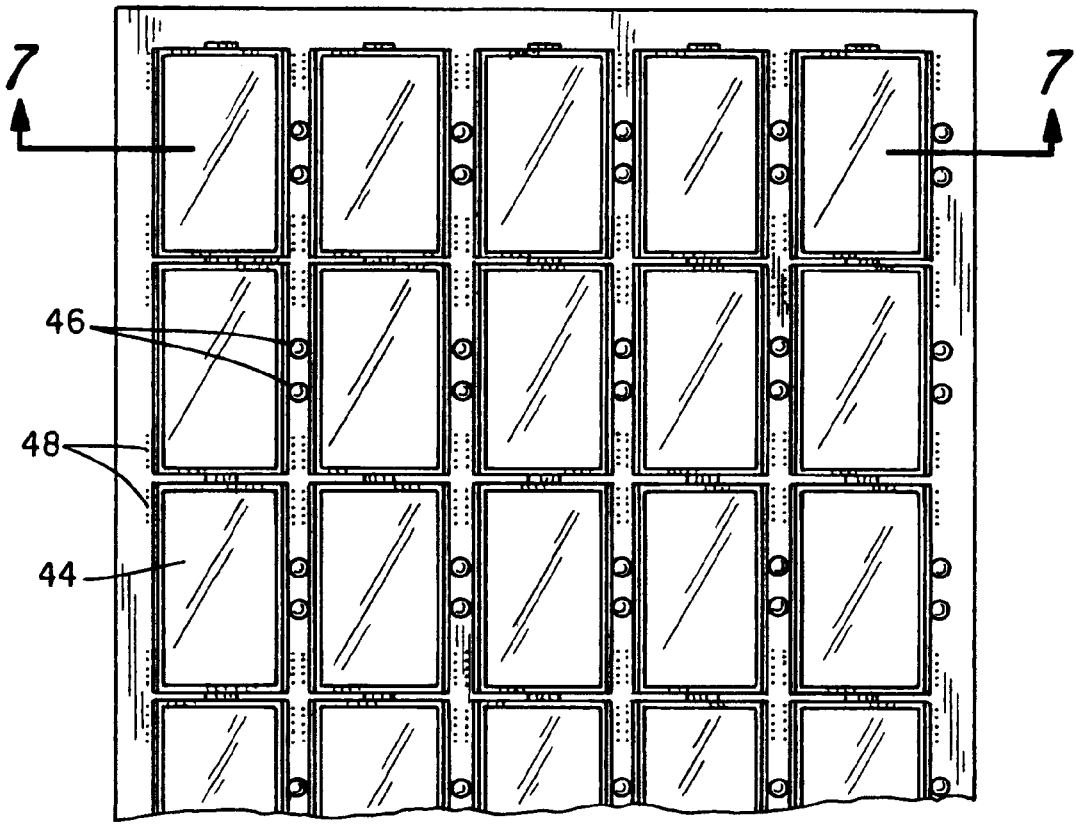
FIG. 6 depicts a plan view of a fragmentary portion of a typical 5×7 pixel character array.
Figure 7:
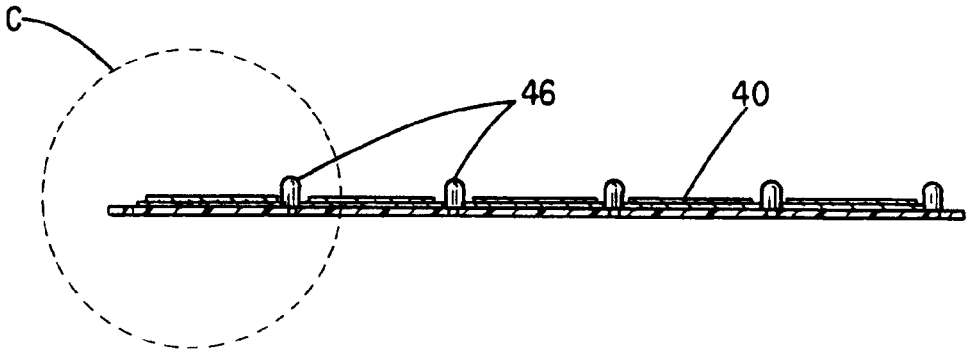
FIG. 7 is a sectional view taken along line A—A of FIG. 6 with the details of one pixel depicted as blown apart.
Figure 8:
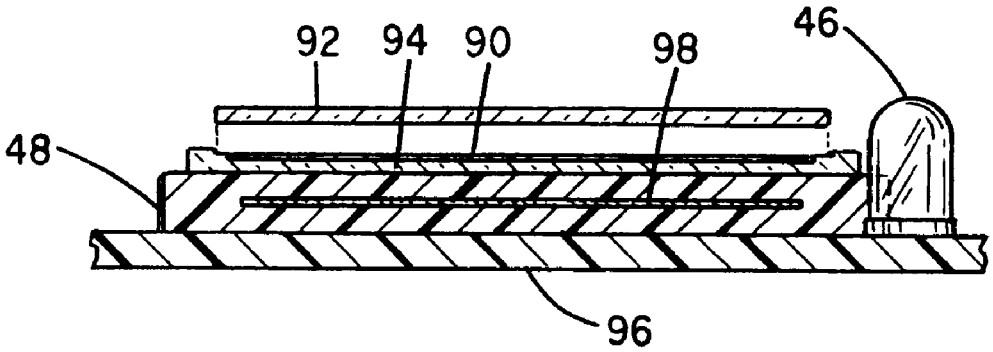
FIG. 8 is a greatly enlarged view of detail C of a pixel of FIG. 7.

The display panel 12 (FIG. 1) depicts a schematic representation of an 8-character by 3-row matrix which makes up a typical sign panel. Each of the elements 40 of the matrix is itself made up of an array that can be used to display a letter or number or a portion of a larger picture developed by the matrix. Thus, each of the display sections 40 further consists of a pixel matrix and the matrix element 40 of FIG. 1 is shown enlarged in FIG. 6 as a partial or fragmentary view of a 5×7 pixel array, each pixel is an electro-optic, non-mecanical shutter device designated 44. Alongside each pixel is a pair of light emitting devices, preferably LEDs 46. Each shutter of the array is independently powered through leads as at 48 and, as shown in FIGS. 7 and 8, and includes a diachroic material 90 sandwiched between upper and lower glass plates 92 and 94 containing associated fastening pins 48 which function as electrical leads which connect the shutter to the circuitry of a base or printed circuit board (PCB) 96. One of a pair of associated LED devices 46 is also connected to the PCB 96.

Diachroic electro-optic shutter devices suitable for the pixels of the invention are available from several sources including Polytronic, Inc. of Richardson, Tex. As shown in the enlarged view of FIG. 8, the diachroic material 90 is contained in a recess etched in the lower one of the glass plates 94. It rests on a thin layer of photo resist that has been coated on the glass plate 94 and the two glass plates are then laminated together with adhesive in a well known manner. Each pixel further contains a highly reflective layer 98 located behind the electro-optic shutter device in the form of a layer of diamond grade reflective sheeting or any other suitable reflective material. The pair of light emitting diodes (LEDs) 46 are mounted in close relation alongside the electro-optic shutter of the pixel.

Each of the electro-optic shutters is a normally closed low transmittance, high absorbance barrier. When a current is applied, the liquid crystals in the diachroic material align and the shutter becomes highly transmissive to light such that one viewing the pixel sees the highly reflective material with or without additional illumination emitted from the LEDs. Each of the elements 40 can be utilized to depict a character such as a letter or number by the patterned arrangement of electro-optic shutters which are energized (opened) simultaneously.

As indicated, each electro-optic shutter operates a pixel. When the display is in the opaque or unenergized stage, approximately 90% of ambient light which hits its surface is absorbed in the diachroic material 50 of the shutter with about 10% of the light being transmitted through the shutter to the reflective surface inside. The 10% of light passed by the diachroic material is reflected back into the shutter where it is again absorbed at the rate of about 90% such that if the shutter is in the opaque stage, only about 1% of the incident light is reflected back out of the electro-optic shutter. The electro-optic shutter typically has a transmitive rate of approximately 70% when energized which means that approximately 49% of the incident light is reflected back out of the display. From this, it can be seen that the dark versus clear stage yields a ratio of approximately 0.5 to 0.01 which gives a contrast ratio of about 50:1. This far exceeds the typical viewing mode requirement of about 8:1 for clarity and ease of reading. Use of the diachroic shutter also has distinct advantages over the twisted numeric (TN) or the super twisted numeric (STN) LCD which use a front polarizer. The polarizer in the crystalline material inherently has a viewing angle which is much more limited than that with the diachroic shutter. Thus, as the viewer moves from direct front viewing to observation from the side, the display will be lost and all characters will be non-readable when viewed from large angles.

Another disadvantage lies in the use of the polarizer itself. Often during daylight hours the observer will be wearing polarized sunglasses which, of course, might cut out the appearance of the sign entirely when viewed through the two polarized layers. In addition, the transmittance of the polarizer is much lower than with the diachroic shutter. A high grade polarizer allows only about 42% of the incident light through and applying this factor for the transmittance both ways through the shutter, only 17.6% of the ambient light is reflected back to the observer. Thus, even though such a sign provides adequate contrast, the display will not be sufficiently intense to view from 900 feet in normal ambient conditions as required by most state highway departments.

As indicated, the pins 48 are used to secure and power each pixel over the secured reflective sheeting. Other mounting devices such as elastomeric strips can be used but have the added mechanics of a formed mounting bevel to hold the strips between the PCB and the shutter. Each individual diachroic pixel on a character printed circuit board is connected to a common liquid crystal display (LCD) driver, backplane and the active segments of the display are driven as if they were individual segments of one large display. This allows all 35 pixels of one 5×7 character to be driven by one LCD driver chip and reduces power consumption and chip expenses. For ease of interconnection, data can be shifted serially through each of the 24 character LCD driver chips making up the 8×3 powered sign matrix. This shifted data holds the proper bit pattern to represent the character being displayed such as A or B or C, etc. In the same fashion, moving arrows can be sequenced and the sign can flash all pixels on or off or any other desired symbol or pattern can be displayed.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. An electrically operated sign system for displaying a time variable message over a full range of ambient light levels comprising:

(a) a sign panel for displaying said message, said sign panel comprising a plurality of character matrices arranged in rows and columns in the panel and wherein each of said character matrices further comprises an array of pixels arranged in rows and columns which may be selectively used to define a character;

(b) wherein said sign panel includes a shuttered system for displaying said message including non-polarizing electro-optic shutters, one shutter for each pixel, said shutters operable between a high light transmitting open state and a low light transmitting closed state and a reflecting surface behind each said shutter for reflecting ambient light received through said electro-optic shutter in said open state back through said shutter;

(c) wherein said sign panel further includes a shutterless system independent of said shutter system for displaying said message using artificial lighting devices, wherein said artificial lighting devices are located alongside of said electro-optic shutters and include for each pixel at least one low power artificial lighting device;

(d) an electrical energizing system connected to selectively operate said electro-optic shutters of said shuttered system and said artificial lighting devices for said shutterless system; and (e) a control system for selectively causing said sign panel to display said message by using a system for displaying said message from the group consisting of said shuttered system and said shutterless system in a manner such that said message can be displayed over a full range of ambient light levels with low power consumption.

2. The sign system as in claim 1 wherein said control system further includes a control device to operate both said shuttered system for displaying said message using ambient light and said shutterless system for displaying said message using artificial lighting at the same time.

3. The sign system as in claim 2 wherein said sign system further comprises a mobile mounting system for carrying said sign panel.

4. The sign system as in claim 2 wherein said control system means further comprises a light sensor for controlling the operation of both said shuttered and shutterless systems for displaying said message.

5. The sign system as in claim 2 wherein said electrical energizing system further comprises a solar-powered energy source for supplying electrical energy to operate said sign stem.

6. The sign system as in claim 5 wherein said low power artificial lighting devices comprise a pair of light emitting diodes for each pixel.

7. The sign system as in claim 1 wherein said sign system further comprises a mobile mounting system for carrying said sign panel.

8. The sign system as in claim 1 wherein said control system further comprises a light sensor for controlling the operation of said shutterless system for displaying said message based on observed ambient light level.

9. The sign system as in claim 8 wherein said light sensor is an incrementally sensitive photocell.

10. The sign system as in claim 9 wherein said low power artificial lighting devices comprise a pair of light emitting diodes for each pixel.

11. The sign system as in claim 1 wherein said control system further comprises a light sensor for controlling the operation of said shuttered system for displaying said message using ambient light.

12. The sign system as in claim 1 wherein said control system further comprises means for controlling a level of output for said artificial lighting devices based on observed ambient light level.

13. The sign system as in claim 1 wherein said low power artificial lighting devices comprise at least one light emitting diode (LED).

14. The sign system as in claim 1 wherein said electrical energizing system further comprises a solar-powered energy source for supplying electrical energy to operate said sign system.

15. The sign system as in claim 14 wherein said solar powered energy source further comprises a solar panel and wherein said apparatus further comprises a solar panel mechanized mounting device for carrying said solar panel, said mechanized mounting device being powered to control the disposition of said solar panel with respect to an elevational angular disposition of the solar panel relative to an angle defining a solar position and the rotational angle of said solar panel with regard to said solar position control being responsive to said light sensor.

16. The sign system as in claim 15 wherein said mechanized maounting device further controls the disposition of said solar panel.

17. The sign system as in claim 15 wherein said mechanized mounting device comprises an electro-mechanical control.

18. The sign system as in claim 1 wherein said electro-optic shutter is a normally closed diachroic shutter.

19. The sign system as in claim 1 wherein each said electro-optic shutter has a transmittance in the range of 10% when closed and 70% when open.

* * * * *

UNITED STATES PATENT AND TRADEMARK OFFICE

CERTIFICATE OF CORRECTION

PATENT NO. : 6,101,750

DATED : August 15, 2000

INVENTOR(S) : James L. Blesener
Amir Amighi

It is certified that error appears in the above-indentified patent and that said Letters Patent is hereby corrected as shown below:

In Column 8, Claim 5, line 48, delete "stem" and insert -- system --; and

In Column 10, Claim 16, line 6, delete "maounting" and insert -- mounting --.

Signed and Sealed this

Tenth Day of April, 2001

Nicholas P. Godici

*Attest:*

NICHOLAS P. GODICI

*Attesting Officer*

*Acting Director of the United States Patent and Trademark Office*